United States Patent [19]

Bankhamer et al.

[11] Patent Number: 4,874,441

[45] Date of Patent: Oct. 17, 1989

[54] EXPLOSIVE FOR WARHEADS AND SOLID ROCKET PROPELLANT

[75] Inventors: Vinzenz Bankhamer, Eugendorf; Gerhard Zeman, Hallein, both of Austria

[73] Assignee: Advanced Explosives Gesellschaft b.R., Hallein, Austria

[21] Appl. No.: 291,010

[22] Filed: Dec. 28, 1988

[30] Foreign Application Priority Data

Jan. 5, 1988 [AT] Austria ..... 13/88

[51] Int. Cl.[4] ..... C06G 33/06

[52] U.S. Cl. ..... 149/42; 149/38; 149/39; 149/77; 149/92; 149/105

[58] Field of Search ..... 149/77, 92, 105, 42, 149/38, 39

[56] References Cited

U.S. PATENT DOCUMENTS

| | | | |
|---|---|---|---|
| 2,992,086 | 7/1961 | Porter | 52/6 |
| 3,299,811 | 1/1967 | Gates | 149/42 |
| 3,617,405 | 11/1971 | Stevenson | 149/42 |
| 3,728,173 | 4/1973 | Cook et al. | 149/42 |
| 3,756,874 | 9/1973 | Chang et al. | 149/19 |
| 3,865,035 | 2/1975 | Munson et al. | 102/66 |

FOREIGN PATENT DOCUMENTS

| | | |
|---|---|---|
| 1084715 | 9/1980 | Canada . |
| 2225979 | 8/1979 | France . |
| 1302361 | 1/1973 | United Kingdom . |

OTHER PUBLICATIONS

European Search Report and Annex EP 89 10 0034.

*Primary Examiner*—Stephen J. Lechert, Jr.
*Attorney, Agent, or Firm*—Scully, Scott Murphy & Presser

[57] ABSTRACT

An explosive with maximum energy yield for warheads and solid rocket propellants comprises a high-energy secondary explosive with inorganic perchlorate and metal component with a high affinity for oxygen as well as desensitizing and binding agents. The oxygen balance sheet of the secondary explosive is balanced by the perchlorate component approximately to provide a complete reaction to give carbon dioxide and water.

Those explosive gases are reduced by the metal component, supplying energy, in accordance with the requirements made on the explosive.

10 Claims, No Drawings

EXPLOSIVE FOR WARHEADS AND SOLID ROCKET PROPELLANT

The invention relates to an explosive for warheads and a solid rocket propellant, comprising a high-energy secondary explosive: with inorganic perchlorate and metal component with a high level of affinity for oxygen as well as desensitising and binding agents.

The publication 'Engineering Design Handbook' from 'Explosives Series Properties of Explosives of Military Interest', U.S. Army Material Command, January 1971, discloses an explosive consisting of hexogen (cyclonite), potassium perchlorate and aluminium with binding agent.

A similar explosive is to be found in U.S. Pat. No. 4,042,430, relating to an explosive which is resistant to high temperature. A common factor in both known explosives is that the oxidising agent is present with a stoichiometric excess. As a result, upon detonation the excess perchlorate is broken up, consuming energy. The oxygen which is liberated can only then be involved in a postreaction with the metal. That situation therefore involves a multi-stage reaction so that the conversion of energy is a relatively slow process.

The invention is based on the problem of providing an explosive with a high energy content per unit of volume. In that connection, the invention seeks to provide that the conversion of energy is to occur very quickly and is to be complete.

The invention solves that problem in that, in a secondary explosive, the oxygen balance sheet is balanced by the perchlorate component approximately to give a complete reaction to form carbon dioxide and water.

Due to complete reaction of the combustible components contained in the explosive a very large amount of explosive gases which can be particularly well and easily reduced by metal is produced. That provides a substantial increase in effectiveness, in comparison with the known explosives.

In addition, the high excess of energy causes very rapid vaporisation of the metals so that the reactivity thereof is substantially increased.

In accordance with claim 2, the perchlorates are the perchlorates of alkali and alkaline earth metals. Perchlorates of, that kind are inexpensive, readily available and easy to produce.

In accordance with claim 3, 40 to 50 g sodium perchlorate is used with 100 g of hexogen (cyclotrimethylenetrinitramine) (cyclonite) or octogen (cyclotetramethylenetetranitramine). By virtue of the specified range in respect to sodium perchlorate, it is possible to provide amounts of binding and desensitising agents, which are correspondingly suited to the respective use, without the stoichiometry of the reaction with the secondary explosive being altered.

Claims 4 and 5 provide that the perchlorate is potassium or calcium perchlorate. By virtue of its low level of hygroscopicity, potassium perchlorate affords particular advantages from the processing point of view. On the other hand, calcium perchlorate has the effect of increasing effectiveness, by virtue of its higher density and the higher specific oxygen component.

Claim 6 provides that the volume of explosive gas and the liberation of energy are controlled by way of the metal component, in that the resulting carbon dioxide and water vapour is reduced to carbon monoxide and hydrogen by the metal. Due to the higher level of affinity of the metal for oxygen, in comparison with carbon and hydrogen, the composition produces a violet reaction of the metal with carbon dioxide and water. They are reduced in that case and a considerable amount of energy is liberated. In that way the explosive gas mix is additionally heated so that the explosive capacity of the explosive is substantially increased. Particularly advantageous values are achieved if the stoichiometry of the metal component causes reduction of the explosive gases to hydrogen and carbon monoxide. If, with a reduced explosive gas volume, the liberation of a particularly large amount of heat is desired, the explosive gases are reduced to elementary carbon and hydrogen by a further increase in the metal component.

Claim 7 sets forth an advantageous development of claim 6. Depending on the nature of the metal used, a proportion of 25 to 45% by weight is provided for the reduction effect.

On the assumption of a high level of affinity for oxygen, claim 8 provides that various light metals can be used.

In the case of an explosive of high density, in accordance with claim 9, it is also possible to use heavy metals with a high level of affinity for oxygen, such as zirconium.

Claim 10 sets forth a high-energy, relatively dense and inexpensive rocket propellant. The explosive is mixed with densitising and binding agents which are specific to solid rocket propellant, and light metals.

The following are essential considerations in relation to the present invention;

These are universal explosives or explosive recipes with maximum energy yields. The explosives according to the invention can be easily matched to requirements arising out of use procedures, the energy content being higher than in the case of known explosives. There are also larger volumes of explosive gas and greater blast effects, than in the case of conventional metal-bearing explosives without oxidising agent.

The invention can also be used without a modification of substance for solid rocket propellants, by adding special densensiting and binding agents and metals which are as light as possible.

The following result was achieved with an explosive, the constituents of which are specified in percent by weight:

Explosive components:

50.2% RDX (cyclotrimethylenetrinitramine)

21.2% $NaClO_4$

25% zirconium 3.6% binding agent.

The following results were achieved on steel with a plate thickness of 8 mm with an explosive body weighing 15 g and measuring 20 mm in diameter and 20 mm in height.

The plate was pierced, the diameter of the hole being 7 mm.,

In a comparison with a known metal-free explosive HWC (94.5% hexogen, 4.5% wax and 1% graphite), a plate of the same thickness was not pierced. The effect produced was a crack which could just be perceived.

A test carried out in the same manner with the explosive Hexal (70% hexogen, 30% aluminium) resulted in the plate not being pierced. There was also no crack.

An explosive of the following composition:

36% HMX (cyclotetramethylenetetranitramine)

16.9% $KClO_4$

45% zirconium
2.1% binding agent when exploded underwater, gave a shock pressure which was 41.5% higher than a sample of the same volume of the underwater explosive SSM TR 8870 (41% TNT(trinitrotoluene), 30% RDX, 24% Al and 5% desensitising agent).

The metal is intended to react in an explosive fashion. For that purpose, it is necessary for the metal firstly to be vaporised. As is known, a high level of energy is required for that purpose as the heat of vaporisation of aluminium, calcium and silicon is very high. When metals are mixed with normal explosives, the relatively low explosion heat thereof is generally scarcely sufficient to cause the metal to be vaporised quickly and completely. In addition, that procedure involves the consumption of much of the heat of the explosion and, before the metal undergoes combustion, the temperature thus falls, thus resulting in the reaction being delayed. It is therefore first necessary to increase the energy of the explosive which is also used In accordance with the invention that is achieved in that a safe explosive such as TNT, hexogen, octogen or nitropenta is cast, fused, mixed or joined by a solvent to such a large amount of perchlorate as to involve complete combustion with a balanced oxygen balance sheet, for example 16 moles of TNT+21 moles of Ca $(ClO_4)_2$ or 8 moles of hexogen+3 moles of $Ca(ClO_4)_2$.

That base mixture is intimately mixed with the metal dust and fused or coalesced therewith. The amount of metal is at least so high that the water is reduced to hydrogen and the carbon dioxide is reduced to carbon monoxide. Upon further reduction, the level of energy increases but the volume of explosive gas falls as the carbon monoxide is reduced to carbon. The amounts of energy produced are very high without involving post-combustion with the oxygen in the air.

If an explosive with a high heat action is to be provided, although the volume of explosive gas is very low, the above mixture of TNT/$Ca(ClO_4)_2$ can be mixed with a mixture of 37.6% Al, 62.4% $Ca(ClO_4)_2$ with a specific weight of 2.67 g/cm$^3$. In that case the level of energy is 31.4 MH/dm$^3$½.

High-energy solid rocket propellants are provided by desensitisation of specifically ammonium perchlorate-bearing mixtures.

We claim:

1. An explosive for warheads and solid rocket propellant, comprising a high-energy secondary explosive with an inorganic perchlorate and metal component with a high level of affinity for oxygen as well as desensitising and binding agents, characterised in that, in said secondary explosive, the oxygen balance sheet is balanced by the perchlorate component which is present in a substantially stoichiometric amount relative to said explosive to approximately give a complete reaction to form carbon dioxide and water.

2. An explosive according to claim 1 characterised in that the perchlorates used are the perchlorates of alkali and alkaline earth metals.

3. An exposive according to claim 1 characterised in that, with 100 g of hexogen (cyclotrimethylactrinitramine), or octogen (cyclotetramethylenetetranitramine) there are 40 to 45 g of sodium perchlorate and corresponding amounts of binding and desensitising agents or, with 100 g of TNT (trinitrotoluene), there are 140 to 150 g of $NaClO_4$.

4. An explosive according to claim 1 characterised in that the perchlorates used are lithium, potassium or calcium perchlorate.

5. An explosive according to claim 3 characterised in that, with 100 g of hexogen(cyclotrimethylmetrinitramine) (cyclotetramethylenetetranitramine), there are 40 to 44 g of calcium perchlorate and corresponding amounts of binding and desensitising agents.

6. An explosive according to claim 1 characterised in that, for the metal component, the volume of explosive gas and the liberation of energy can be controlled by the resulting carbon dioxide and water vapour being reduced by the metal to carbon monoxide and hydrogen or selectively carbon and hydrogen.

7. An explosive according to claim 1 characterised in that, depending on the respective nature of the metal, the explosive contains from 25 to 45% by weight of metal component.

8. An explosive according to claim 1 characterised in that the metals are silicon, magnesium, calcium, aluminium or mixtures or alloys consisting thereof.

9. An explosive according to claim 1 characterised in that the metals are zinc, manganese, titanium, zirconium, or mixtures or alloys consisting thereof.

10. An explosive for use as a solid rocket propellant according to claim 1 characterised in that the explosive contains suitable desensitisation and binding agents which are specific to solid rocket propellant, as well as light metals, and mixtures or alloys thereof.

* * * * *